US008528272B1

(12) United States Patent
Foss

(10) Patent No.: US 8,528,272 B1
(45) Date of Patent: Sep. 10, 2013

(54) DETENTION FACILITY CELL DOOR LOCK AND HOUSING ASSEMBLY

(75) Inventor: Brian S Foss, Madison, AL (US)

(73) Assignee: Willo Products Company, Inc., Decatur, AL (US)

( * ) Notice: Subject to any disclaimer, the term of this patent is extended or adjusted under 35 U.S.C. 154(b) by 0 days.

(21) Appl. No.: 13/478,655

(22) Filed: May 23, 2012

(51) Int. Cl.
*E04H 3/08* (2006.01)

(52) U.S. Cl.
USPC ..... 52/106

(58) Field of Classification Search
USPC ..... 52/645, 646, 204.1, 106; 49/394, 49/15, 17; 70/370, 448, 451, 102, 104; 292/3, 292/32, 37, 137, 156, 163, 164, 169, 169.13, 292/169.14, 169.15, 182, 138, 140, 340, 292/DIG. 40, DIG. 41, DIG. 51, DIG. 53, 292/DIG. 55
See application file for complete search history.

(56) References Cited

U.S. PATENT DOCUMENTS

| | | | | | |
|---|---|---|---|---|---|
| 1,665,243 | A * | 4/1928 | Whitehouse | 49/17 |
| 1,723,126 | A * | 8/1929 | Best | 70/339 |
| 1,739,897 | A * | 12/1929 | Garber | 49/17 |
| 1,940,639 | A * | 12/1933 | White | 49/16 |
| 2,146,552 | A * | 2/1939 | Ralston | 49/17 |
| 2,170,521 | A * | 8/1939 | Rodth | 340/542 |
| 2,290,114 | A * | 7/1942 | Metzler | 49/15 |
| 2,397,926 | A * | 4/1946 | Creech | 49/54 |
| 2,417,167 | A * | 3/1947 | Johnston | 49/16 |
| 3,893,723 | A * | 7/1975 | Boule | 292/140 |
| 4,180,287 | A * | 12/1979 | Youngblood et al. | 292/144 |
| 4,691,542 | A * | 9/1987 | Young | 70/129 |
| 4,887,856 | A * | 12/1989 | Percoco et al. | 292/337 |
| 4,913,475 | A * | 4/1990 | Bushnell et al. | 292/144 |
| 5,267,461 | A * | 12/1993 | Eizen | 70/451 |
| 5,299,385 | A * | 4/1994 | McConnell | 49/18 |
| 5,881,585 | A * | 3/1999 | Kang | 70/107 |
| 6,058,746 | A * | 5/2000 | Mirshafiee et al. | 70/107 |
| 6,282,931 | B1 * | 9/2001 | Padiak et al. | 70/279.1 |
| 6,293,131 | B1 * | 9/2001 | Lemettinen et al. | 70/278.7 |
| 6,374,650 | B1 * | 4/2002 | Newman | 70/131 |
| 6,581,333 | B2 * | 6/2003 | Kimball | 49/504 |
| 6,684,570 | B1 * | 2/2004 | Robledo | 49/394 |
| 6,826,937 | B2 * | 12/2004 | Su | 70/370 |
| 7,296,448 | B1 * | 11/2007 | Shaw | 70/283 |
| 7,707,862 | B2 * | 5/2010 | Walls et al. | 70/107 |
| 7,836,735 | B2 * | 11/2010 | Liu | 70/81 |
| 7,874,189 | B2 * | 1/2011 | Martin | 70/85 |
| 2002/0053165 | A1 * | 5/2002 | Secoolish et al. | 49/15 |
| 2007/0240465 | A1 * | 10/2007 | Clifford et al. | 70/370 |
| 2010/0269431 | A1 * | 10/2010 | Young | 52/204.1 |

* cited by examiner

*Primary Examiner* — Joshua J Michener
*Assistant Examiner* — Keith Minter
(74) *Attorney, Agent, or Firm* — George P. Kobler; Lanier Ford Shaver & Payne P.C.

(57) ABSTRACT

A detention facility cell door lock housing assembly includes a lock mechanism housing to be mounted on the exterior surface of a cell wall adjacent the cell door opening and lock pocket housing correspondingly mounted on the exterior surface of the cell door. The lock mechanism housing includes a stepped side wall having at least a portion with an exterior facing surface to act as a stop. The lock pocket housing includes an opposingly stepped side wall, such that when the door is close the respective side walls fit together and the stop is engaged to prevent further door travel.

10 Claims, 5 Drawing Sheets

DETENTION FACILITY CELL DOOR LOCK AND HOUSING ASSEMBLY

BACKGROUND

1. Field

The present invention relates generally to detention facility cell door locks, and in particular to detention facility cell door locks with protective housings, and further, to such protective housings that are mounted on the exterior of the cell.

2. Description of the Problem and Related Art

Many detention facilities have cells that were originally provided with conventional swinging doors locked with a lock mounted in a door frame jamb and that fits within a 2" wide face. Many of these locks have to be replaced due to inmate access to the lock bolt (tampering), fatigue and destructive physical abuse directly to the door and frame.

Conventional frame- and door-mounted cell lock mechanisms are subject to tampering because the thickness of a typical door frame and the relatively thin width of the door stop (typically about ⅝ of an inch) gives an inmate an opportunity to use a playing card, a credit card, a calling card, or something similar that is stiff but flexible, and small enough to be secretly carried, to block the lock bolt by inserting the object in the path of the lock bolt as the cell door is closing.

An inexpensive alternative to complete replacement of the door, frame and lock, and a common practice is to replace the lock and lock pocket by cutting away a large portion of the wall and frame and installing a new lock pocket with lock known as "recessed mounting." This invasive method can compromise the structural integrity of the wall and door and involves extensive preparation for demolition and clean up after installation. The time to modify a door and frame in this manner means detention facility staff must closely coordinate the relocation and heightened supervision of inmates for prolonged periods.

Accordingly, a structure is needed that securely supports a lock mechanism for prison or jail cells that deters or inhibits tampering, but may be installed quickly, cheaply, and does not impair the structural integrity of the existing wall and door.

SUMMARY

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

A detention facility cell door lock housing assembly includes a lock mechanism housing to be mounted on the exterior surface of a cell wall adjacent the cell door opening and lock pocket housing correspondingly mounted on the exterior surface of the cell door. The lock mechanism housing includes a stepped side wall having at least a portion with an exterior facing surface to act as a stop. The lock pocket housing includes an opposingly stepped side wall, such that when the door is close the respective side walls fit together and the stop is engaged to prevent further door travel.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The various embodiments of the present invention and their advantages are best understood by referring to FIGS. 1 through 4 of the drawings. The elements of the drawings are not necessarily to scale, emphasis instead being placed upon clearly illustrating the principles of the invention. Throughout the drawings, like numerals are used for like and corresponding parts of the various drawings.

This invention may be provided in other specific forms and embodiments without departing from the essential characteristics as described herein. The embodiments described above are to be considered in all aspects as illustrative only and not restrictive in any manner. The appended claims rather than the description and drawings indicate the scope of the invention.

Figure 1:
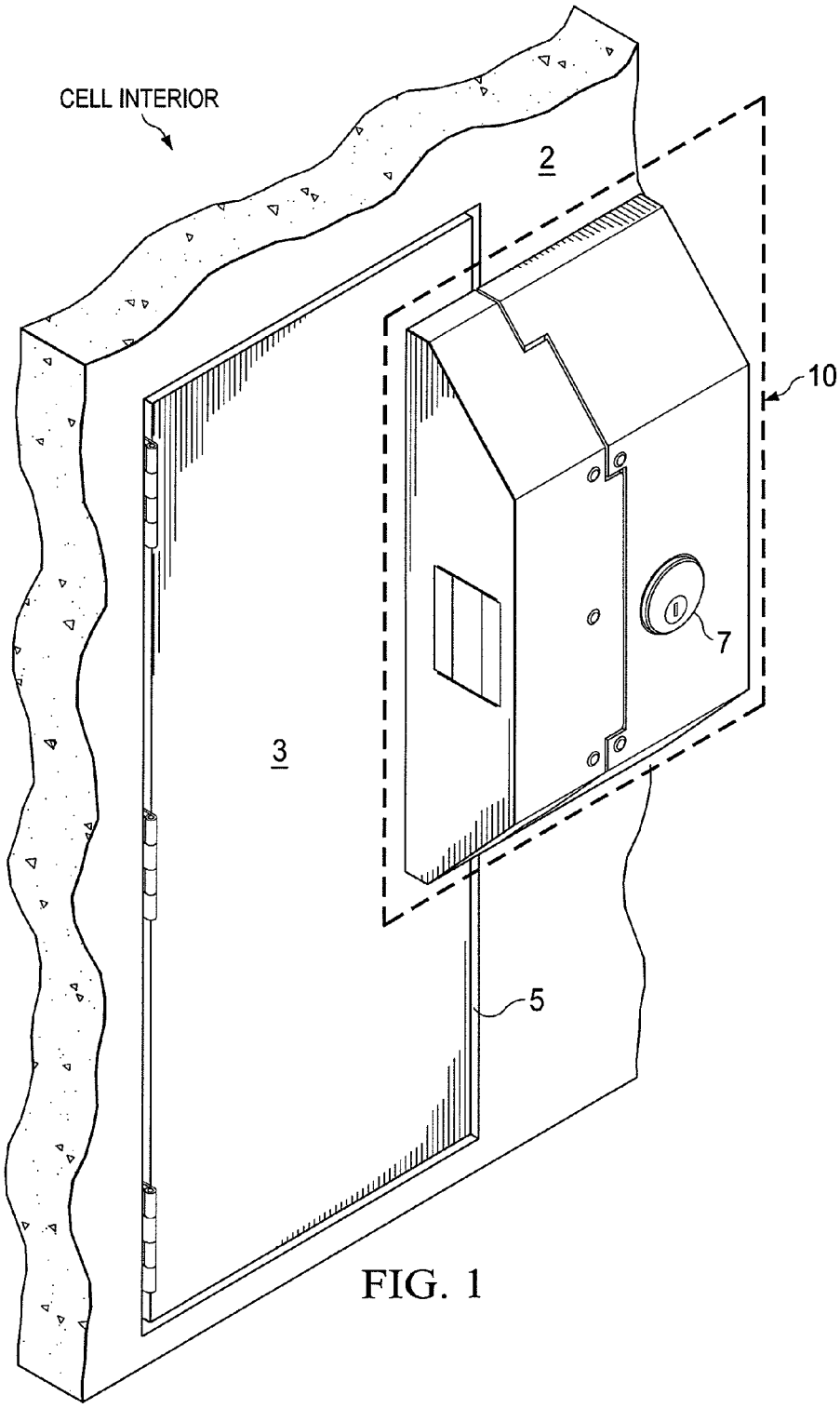
FIG. 1 is a perspective view of an exemplary lock housing assembly for mounting on the exterior surfaces of the door and wall (partial views) of a detention facility cell.
Figure 2A:
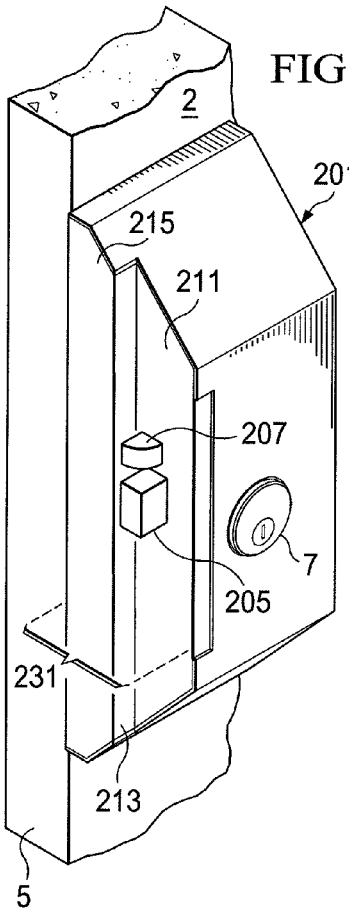
FIG. 2A depicts an exemplary lock mechanism housing mounted to the exterior surface of a cell wall and door frame.
Figure 2B:
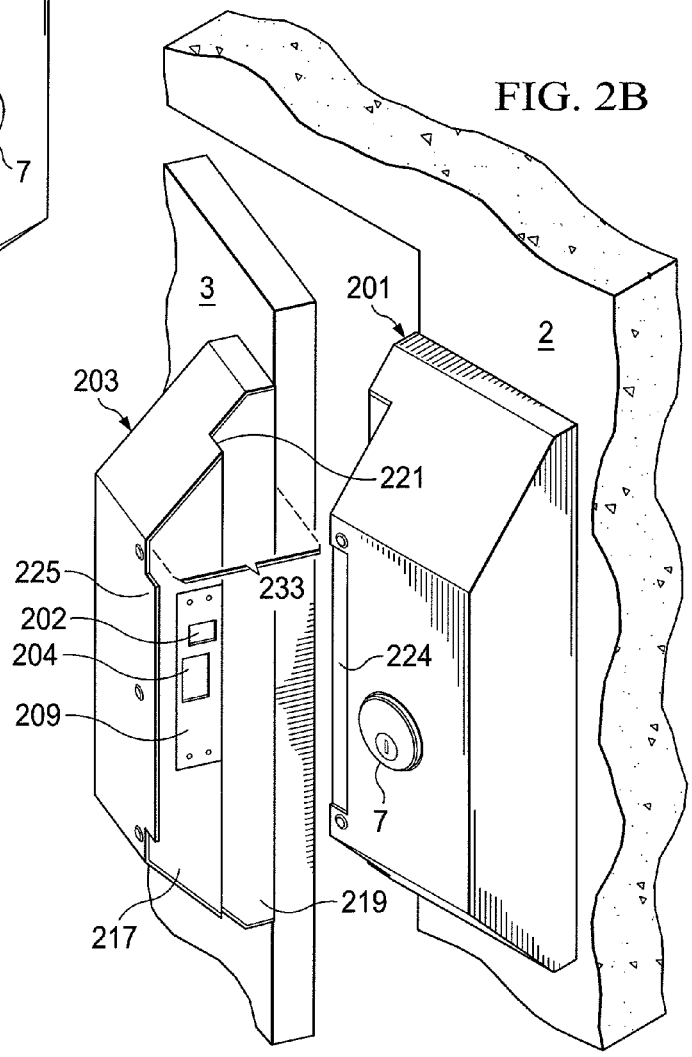
FIG. 2B shows an opposing view of the exemplary lock mechanism housing of FIG. 2B along with a lock pocket housing mounted to the exterior surface of a cell door.
Figure 3A:
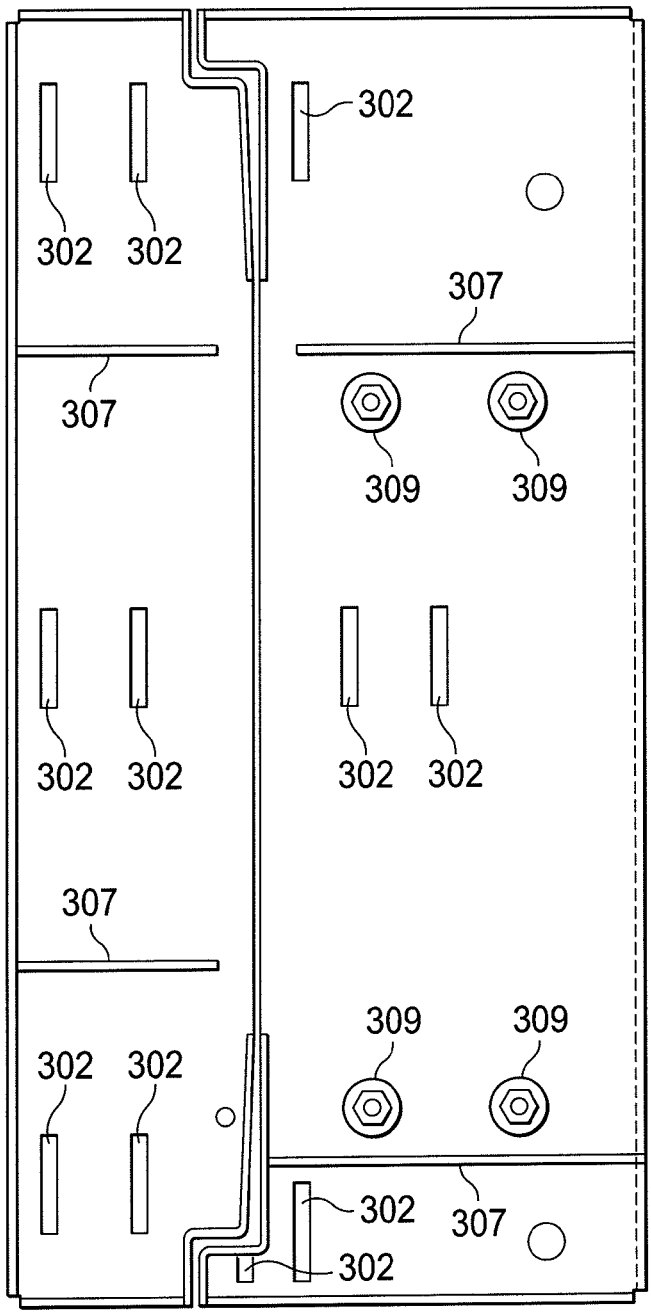
FIG. 3A is an elevation view of respective exemplary mounting plates for mounting the lock housing assembly.
Figure 3C:
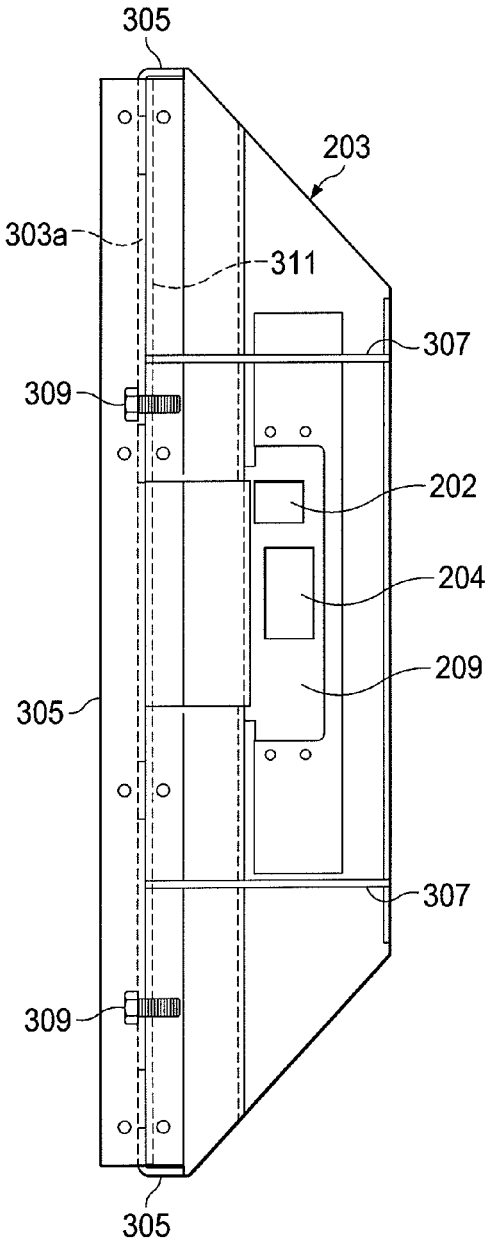
FIG. 3C is a side elevational view of an exemplary lock pocket housing.
Figure 3D:
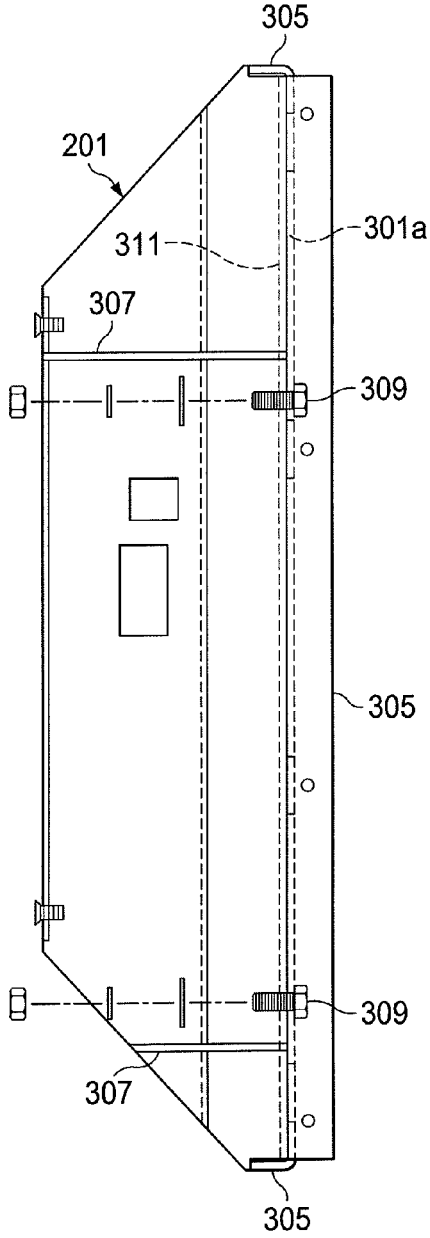
FIG. 3D is a side elevational view of an exemplary lock mechanism housing.
Figure 3B:
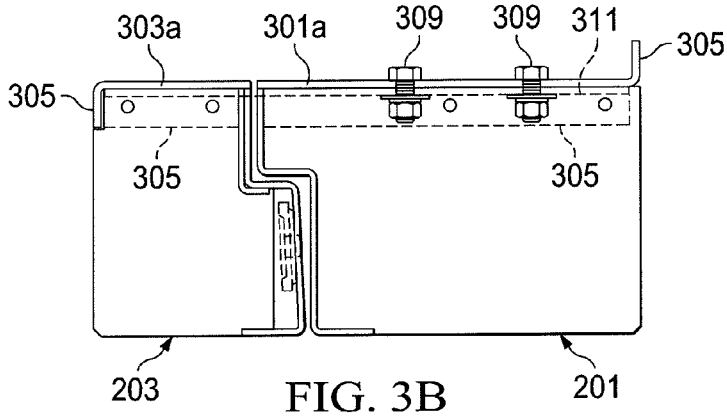
FIG. 3B is a plan view from above of the lock housing assembly of FIG. 1.

FIG. 1 depicts an exemplary lock housing assembly 10 enclosed in which is a lock mechanism 7. The housing assembly 10 is mounted on the exterior surfaces of a cell door 3 and wall 2 across the door jamb 5. FIGS. 2A & 2B show the respective exterior components of the housing assembly 10 comprising a lock mechanism housing 201 that is mounted to the wall 2 adjacent the existing door jamb 5. The lock mechanism housing 201 supports the lock mechanism 7, and is configured with a frame lock facing wall 231 stepped-shaped to include a rabbet portion 211 in which is defined openings through which a lock bolt 205 and a lock roller bolt 207 may be selectively extended when the cell door 3 is closed. The frame lock facing wall is further shaped to define a stop 213, analogous to a conventional door stop that is defined by a soffit in a conventional door frame. The stop 213 is essentially a perpendicular transition between the rabbet portion 211 and a shoulder portion 215 and extends generally parallel to the cell wall exterior surface. The shoulder portion 215 extends between the wall surface and the stop 213.

FIG. 2B provides a view of a lock pocket housing 203 mounted to the exterior surface of the door 3 and configured with a door strike mounting wall formed to define surfaces opposing those defined by the frame lock facing wall, having one surface that will seat against the stop 213 when the door 3 is closed. The lock pocket housing 203 includes a second shoulder portion 217 in which is defined an opening 204 for receiving the lock bolt 205 and an opening 202 for receiving the lock roller bolt 207. A strike plate 209 may be installed with corresponding openings to protect the structure of the shoulder portion 217 surrounding the openings 204, 202. The door strike mounting wall 233 is shaped to include a stop mating surface 221 interposed between the shoulder portion 217 and a second rabbet portion 219. An additional optional feature is a guard flange 225 extending laterally from the front of the lock pocket housing 203. The lock mechanism housing 201 is preferably configured with a third rabbet 224 dimensioned to receive the guard flange 225 when the door 3 is closed in order to provide a flush face across the front of the assembly 10. The guard flange 225 inhibits access to the locking bolts from the outside of the cell when the cell door is closed.

Figure 4:
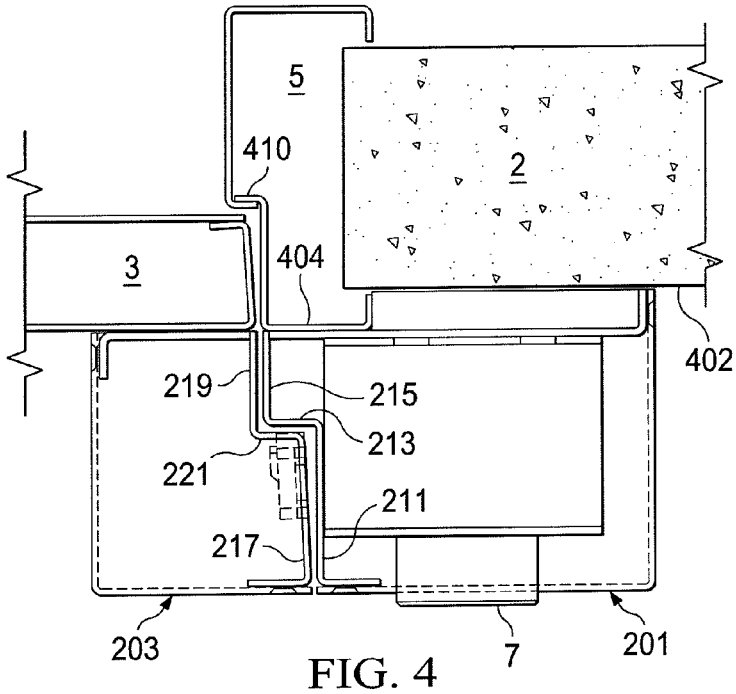
FIG. 4 is a section view from above showing the engaging of the lock housing assembly mounted on the exterior surfaces of the cell door and cell walls.

FIG. 4 is a cross-section view, looking vertically downward, which illustrates the lock mechanism housing 201 mounted on the exterior surface 402 of the existing cell wall 2 and the exterior surface 404 of the existing door frame 5. The lock pocket housing 203 similarly is mounted on the exterior surface 406 of the existing door 3. This view also shows the existing door frame 5 defines a door stop 410 against which the door 3 is seated when the door is closed.

It can be seen that the two respective housings 201, 203 are shaped such that when the door 3 is closed the stop mating surface 221 of lock pocket housing 203 is seated against the stop 213 of the lock mechanism housing 201. Further, the housings 201, 203 are formed so that the shoulder portion 215 and the second rabbet portion 219 extend outward from the door frame 5 and door 3, respectively, and formed so that the stop 213 extends laterally offset vis-á-vis the door frame 5, i.e., away from the door frame edge. Moreover, respective opposing surfaces 215, 219 and 211, 217, are matingly stepped and dimensioned appropriately to provide a close engagement of the two housing components 201, 203, minimizing the gap between the two opposing surfaces.

The depth of the shoulder portion 215 should optimally be as great as possible while still accounting for space constraints to reduce the likelihood of an inmate inserting objects between the lock mechanism bolts 205, 207 and their respective openings 204, 202 in the lock pocket housing 203, e.g., a playing card, credit card, or other objects which may be stiff but flexible and prevent the lock bolt from engaging. The width of the stop 213 is also dimensioned to be as wide as possible. Preferably, the width of the stop 213 should be greater than that of the standard door stop 410 which is about ⅝ inch. Still more preferably, the width of the stop 213 is between about ⅞ inch to about one inch, or greater, including widths of about 15⁄16 inch. As with the extended depth of the shoulder portion 215, the wider stop 213 surface reduces the ability of an inmate to tamper with the lock function by interposing a stiff but flexible card.

Both housing components 201, 203 are preferably formed with sloping top and bottom surfaces. This feature provides enhanced protection of the locking mechanism from overhead impacts as well as a clean, modern appearance.

FIGS. 3A through 3D varying aspects of an exemplary lock housing assembly 10 and, in particular illustrate exemplary methods of mounting the assembly 10 to the cell door 3 and cell wall 2 exterior surfaces. The exemplary assembly 10, therefore, comprises a wall mounting plate 301 and a door mounting plate 303 for mounting of the lock mechanism housing 201 and the lock pocket housing 203 respectively.

Various methods are known in the art for securely attaching similar structures to wall and door surfaces, and thus, the following description is merely provided for illustration, and should not be considered to be the sole technique for mounting of the lock housing assembly 10. Accordingly, in a preferred embodiment, each mounting plate 301, 303 comprises a back plate 301*a*, 303*a*, in each of which may be defined a plurality of slots 302 that can provide access to the mounting surface for a welding torch, thus welding the mounting plate 301, 303 to the mounting surface. Of course, the plates may also be bolted to the wall or door, but this requires drilling holes in each structure which increases installation time.

Each mounting plate 301, 303 may include a plurality of attachment flanges 305 that extend perpendicularly, in either direction, from the back plate 301*a*, 303*a*, and may be configured with fastener openings to allow attachment of the housing 201, 203 to the mounting plate 301, 303. Additionally, the housing 201, 203, may include a back wall 311 and may be attached to each mounting plate 301, 303 with a plurality of suitable fasteners 309 through openings in each wall 311. Each housing 201, 203 also may include reinforcing ribs 307 and other structures for supporting and mounting of a locking mechanism.

An additional feature resides in the design of the lock pocket housing 203 in that it is hollow. Often, an inmate will stuff any kind of debris, such as paper scraps or candy or food wrappers, in the bolt hole in the door frame, which, if it is shallow enough, will fill in a relatively short amount of time and may prevent the lock bolt from fully engaging the bolt hole, compromising the security of the cell. A hollow lock pocket housing 203 deters this tactic as it would require a greater amount of debris and a longer period of time to full sufficiently to interfere with the lock bolt operation. In addition, the housing 203 may optionally be configured with an opening to allow periodic cleaning of the housing interior.

It will be appreciated that since the respective housings are surface-mounted to the existing door and frame, the structural integrity of the wall and frame are preserved. Further, installation time, and thus, down time is greatly reduced, which in turn, reduces disruption of the security routine, and temporary relocation of inmates during installation. Applicant has successfully tested prototypes of the above-described structures and installation method in accordance with ASTM F1450-05 standard methods for hollow metal swinging door assemblies for detention and correctional facilities.

As described above and shown in the associated drawings, the present invention comprises an apparatus for a detention facility cell door lock housing assembly. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. An apparatus for mounting and supporting a locking mechanism for locking a detention cell door for a detention cell, said cell door having a surface exterior to the cell and supported within a door opening defined in a cell wall, said cell wall also having a surface exterior to the cell, said apparatus comprising:

a first housing for enclosing a locking mechanism mounted to the exterior surface of the cell wall adjacent an edge of the door opening and comprising a first wall including a stop surface disposed entirely external to the cell and the door opening and overlapping a portion of the exterior wall surface, and in which a first aperture is defined through which a selectively extendable lock bolt can extend; and a second housing mounted to the exterior surface of said door, said second housing having a second wall formed to conformably abut against said stop surface when said cell door is closed and in which a second aperture is defined through which said lock bolt can extend when the door is closed and locked.

2. The apparatus of claim 1, further comprising:

a first mounting plate fixed to said exterior surface of said cell wall for providing an attachment for said first housing; and a second mounting plate fixed to said exterior surface of said cell door for providing an attachment for said second housing.

3. The apparatus of claim 2, wherein said first and second mounting plates are fixed to said respective exterior surfaces by at least one of welding or fasteners.

4. The apparatus of claim 2, wherein said first and second mounting plates include a back plate in which is defined a plurality of openings, and wherein said first and second mounting plates are fixed to said respective exterior surfaces by creating welds in each of said plurality of openings.

5. The apparatus of claim 1, wherein said stop is formed to have a width of about ⅞ inch or greater.

6. The apparatus of claim 5, wherein said stop is formed to have a width of about 15/16 inch or greater.

7. The apparatus of claim 5, further comprising:

a first mounting plate fixed to said exterior surface of said cell wall for providing an attachment for said first housing; and a second mounting plate fixed to said exterior surface of said cell door for providing an attachment for said second housing.

8. The apparatus of claim 7, wherein said first and second mounting plates include a back plate in which is defined a plurality of openings, and wherein said first and second mounting plates are fixed to said respective exterior surfaces by creating welds in each of said plurality of openings.

9. The apparatus of claim 1, wherein said first wall further comprises a shoulder portion extending generally perpendicularly between said exterior surface of said cell wall and said stop surface.

10. The apparatus of claim 9, further comprising:

a first mounting plate fixed to said exterior surface of said cell wall for providing an attachment for said first housing; and a second mounting plate fixed to said exterior surface of said cell door for providing an attachment for said second housing; and wherein said first and second mounting plates include a back plate in which is defined a plurality of openings, and wherein said first and second mounting plates are fixed to said respective exterior surfaces by creating welds in each of said plurality of openings.

* * * * *